US007604026B2

(12) United States Patent
Herman

(10) Patent No.: US 7,604,026 B2
(45) Date of Patent: Oct. 20, 2009

(54) TRIANGULAR WEFT FOR TAD FABRICS

(75) Inventor: Jeffrey B. Herman, Bala Cynwyd, PA (US)

(73) Assignee: Albany International Corp., Albany, NY (US)

( * ) Notice: Subject to any disclaimer, the term of this patent is extended or adjusted under 35 U.S.C. 154(b) by 0 days.

(21) Appl. No.: 11/639,614

(22) Filed: Dec. 15, 2006

(65) Prior Publication Data

US 2008/0142109 A1 Jun. 19, 2008

(51) Int. Cl.
*D21F 7/08* (2006.01)
*D03D 3/04* (2006.01)
*D03D 25/00* (2006.01)

(52) U.S. Cl. ..... 139/383 A; 139/383 AA; 162/358.2

(58) Field of Classification Search ..... 139/383 A; 162/358.1, 348, 349, 900, 901, 903
See application file for complete search history.

(56) References Cited

U.S. PATENT DOCUMENTS 3,158,984 A * 12/1964 Butler ..... 57/210
3,167,281 A * 1/1965 Hill ..... 245/8
3,309,265 A 3/1967 Krake
3,464,452 A * 9/1969 Brouwer et al. ..... 139/452
4,191,609 A 3/1980 Trokhan
4,290,209 A * 9/1981 Buchanan et al. ..... 34/123
4,621,663 A * 11/1986 Malmendier ..... 139/383 A
4,633,596 A * 1/1987 Josef ..... 34/116
4,829,681 A * 5/1989 Josef ..... 34/123
4,987,929 A * 1/1991 Wilson ..... 139/383 A
5,023,132 A * 6/1991 Stanley et al. ..... 442/195
5,217,577 A * 6/1993 Steiner ..... 162/232
5,240,763 A * 8/1993 Wagner et al. ..... 428/222
5,361,808 A 11/1994 Bowen, Jr
5,378,537 A 1/1995 Masuda et al.
5,514,456 A * 5/1996 Lefferts ..... 428/222
5,534,333 A * 7/1996 Keller et al. ..... 428/222
5,617,903 A 4/1997 Bowen, Jr.
5,713,398 A * 2/1998 Josef ..... 139/383 A
5,819,811 A * 10/1998 Baker et al. ..... 139/383 AA
6,237,644 B1 * 5/2001 Hay et al. ..... 139/383 A
6,265,331 B1 7/2001 Steiner
6,589,392 B1 * 7/2003 Skinner et al. ..... 162/348
6,875,314 B2 * 4/2005 Korfer et al. ..... 162/358.2
6,875,315 B2 * 4/2005 Bakken et al. ..... 162/362
7,048,830 B2 * 5/2006 Heger et al. ..... 162/348

(Continued)

FOREIGN PATENT DOCUMENTS

CA 2 416 961 A 1/2003

(Continued)

*Primary Examiner*—Bobby H Muromoto, Jr.
(74) *Attorney, Agent, or Firm*—Frommer Lawrence & Haug, LLP; Ronald R. Santucci

(57) ABSTRACT

A through-air-drying (TAD) fabric for producing tissue paper and related products on a papermaking machine comprising a plurality of warp yarns interwoven with a plurality of weft yarns to produce pockets on a paper-side surface of the fabric. The weft yarns have a substantially triangular cross-section and are oriented with their flat surface facing a machine side surface of the fabric. The points interlacing with the warp as they pass over and under the weft yarns produce an increased pocket depth and volume in the TAD fabric.

14 Claims, 4 Drawing Sheets

U.S. PATENT DOCUMENTS

| | | | | |
|---|---|---|---|---|
| 7,101,404 | B2 * | 9/2006 | Korfer | 8/114.6 |
| 2003/0003299 | A1 | 1/2003 | Johnson et al. | |
| 2005/0003724 | A1 | 1/2005 | FitzPatrick | |
| 2006/0063451 | A1 | 3/2006 | Serr et al. | |

FOREIGN PATENT DOCUMENTS

| | | | |
|---|---|---|---|
| DE | 41 41 139 | C2 | 8/1995 |
| EP | 0 806 519 | A | 11/1997 |
| GB | 1053954 | | 1/1967 |
| WO | WO 96/04418 | | 2/1996 |

* cited by examiner

TRIANGULAR WEFT FOR TAD FABRICS

BACKGROUND OF THE INVENTION

1. Field of the Invention

The present invention relates to the papermaking arts. More specifically, the present invention relates to through-air-drying (TAD) fabrics used in the manufacture of bulk tissue and towel, and of nonwoven articles and fabrics.

2. Description of the Prior Art

Soft, absorbent disposable paper products, such as facial tissue, bath tissue and paper toweling, are a pervasive feature of contemporary life in modern industrialized societies. While there are numerous methods for manufacturing such products, in general terms, their manufacture begins with the formation of a cellulosic fibrous web in the forming section of a paper machine. The cellulosic fibrous web is formed by depositing a fibrous slurry, that is, an aqueous dispersion of cellulose fibers, onto a moving forming fabric in the forming section. A large amount of water is drained from the slurry through the forming fabric, leaving the cellulosic fibrous web on the surface of the forming fabric.

The cellulosic fibrous web is then transferred to a through-air-drying (TAD) fabric or belt by means of an air flow, brought about by vacuum or suction, which deflects the web and forces it to conform, at least in part, to the topography of the TAD fabric or belt. Downstream from the transfer point, the web, carried on the TAD fabric or belt, passes through a through-air dryer, where a flow of heated air, directed against the web and through the TAD fabric or belt, dries the web to a desired degree. Finally, downstream from the through-air dryer, the web may be adhered to the surface of a Yankee dryer and imprinted thereon by the surface of the TAD fabric or belt, for further and complete drying. The fully dried web is then removed from the surface of the Yankee dryer with a doctor blade, which foreshortens or crepes the web and increases its bulk. The foreshortened web is then wound onto rolls for subsequent processing, including packaging into a form suitable for shipment to and purchase by consumers.

As noted above, there are many methods for manufacturing bulk tissue products, and the foregoing description should be understood to be an outline of the general steps shared by some of the methods. For example, the use of a Yankee dryer is not always required, as, in a given situation, foreshortening may not be desired, or other means, such as "wet creping", may have already been taken to foreshorten the web.

It should be appreciated that TAD fabrics may take the form of endless loops on the paper machine and function in the manner of conveyors. It should further be appreciated that paper manufacture is a continuous process which proceeds at considerable speeds. That is to say, the fibrous slurry is continuously deposited onto the forming fabric in the forming section, while a newly manufactured paper sheet is continuously wound onto rolls after it is dried.

Those skilled in the art will appreciate that fabrics are created by weaving, and have a weave pattern which repeats in both the warp or machine direction (MD) and the weft or cross-machine direction (CD). Woven fabrics take many different forms. For example, they may be woven endless, or flat woven and subsequently rendered into endless form with a seam. It will also be appreciated that the resulting fabric must be uniform in appearance; that is, there are no abrupt changes in the weave pattern to result in undesirable characteristics in the formed paper sheet. In addition, any pattern marking imparted to the formed tissue will impact the characteristics of the paper.

Contemporary papermaking fabrics are produced in a wide variety of styles designed to meet the requirements of the paper machines on which they are installed for the paper grades being manufactured. Generally, they comprise a base fabric woven from monofilament and may be single-layered or multi-layered. The yarns are typically extruded from any one of several synthetic polymeric resins, such as polyamide and polyester resins, used for this purpose by those of ordinary skill in the paper machine clothing arts.

The present application is concerned, at least in part, with the TAD fabrics or belts used on the through-air dryer of a bulk tissue machine although it may have other applications beyond this. However, the present application is primarily concerned with a TAD fabric.

such fabric may also have application in the forming section of a bulk tissue or towel machine to form cellulosic fibrous webs having discrete regions of relatively low basis weight in a continuous background of relatively high basis weight. Fabrics of this kind may also be used to manufacture nonwoven articles and fabrics, which have discrete regions in which the density of fibers is less than that in adjacent regions whereby the topography of the nonwoven article is changed, by processes such as hydroentanglement.

The properties of absorbency, strength, softness, and aesthetic appearance are important for many products when used for their intended purpose, particularly when the fibrous cellulosic products are facial or toilet tissue, paper towels, sanitary napkins or diapers.

Bulk, cross directional tensile, absorbency, and softness are particularly important characteristics when producing sheets of tissue, napkin, and towel paper. To produce a paper product having these characteristics, a fabric will often be constructed so that the top surface exhibits topographical variations. These topographical variations are often measured as plane differences between strands in the surface of the fabric. For example, a plane difference is typically measured as the difference in height between a raised weft or warp yarn strand or as the difference in height between MD knuckles and CD knuckles in the plane of the fabric's surface. Often, the fabric surface will exhibit pockets in which case plane differences may be measured as a pocket depth.

Additionally, drying capability of an industrial fabric is very essential for its use in processes such as TAD. Typically, a standard TAD fabric design in the papermaking industry for making paper towel, which is a 5-shed, 3×2 weave pattern. This design exhibits higher sheet caliper and absorbency, which allows lower sheet basis weight. The other design that is typically used in toilet tissue production is a 5-shed, 4×1 weave pattern which has demonstrated to result in a higher sheet softness. Both designs have proven to be robust in the hot, humid, TAD environment with better sheet properties. Fabric designers realize that pocket depth formed by the weave pattern is also important so multilayer thicker fabrics have been tried. However, these multilayer designs pose some serious drawbacks, such as increased fabric water content as they generally carry more water, which results in higher drying time. The primary mechanism for producing low density high caliper tissue webs with the TAD process is the pocket depth of the fabric. Therefore, it is the pocket depth of the fabric that dictates the caliper of the tissue web. A close study of the designs discussed above showed that both warp and weft yarns are primarily responsible for the creation of the depth of the pocket, thus limiting sheet caliper generation. Particularly, in single layer designs, the weft yarns show better control of pocket depth than the warp yarns. It is therefore observed that changing the profile of the weft yarns to a triangle or substantially triangular shaped cross-section instead of the conventional round yarns results in an increase of pocket depth, leading to higher sheet caliper and other desirable sheet characteristics.

The present invention provides an improved TAD fabric which exhibits favorable characteristics for the formation of tissue paper and related products.

SUMMARY OF THE INVENTION

Accordingly, the present invention is a TAD fabric, although it may find application in the forming, pressing and drying sections of a paper machine. As such, it is a papermaker's fabric which comprises a plurality of warp yarns interwoven with a plurality of weft yarns.

The present invention is preferably a TAD fabric comprising a plurality of warp yarns interwoven with a plurality of weft yarns to produce a paper-side surface pattern characterized by pockets of higher depth and volume for the same mesh and count. In the fabric according to the present invention, the weft yarns have a triangular cross-section or substantially triangular shaped cross-section and are oriented with their flat surface facing a machine side surface of the fabric. The points interlacing with the warp as they pass over and under the triangular shaped weft yarns produce increased pocket depth and volume in the TAD fabric.

It is therefore an object of the present invention to increase pocket depth and pocket volume of an industrial fabric in order to improve sheet properties such as sheet caliper, bulk and absorbency in TAD or other sheet forming type processes that utilize a TAD or structured fabric to imprint a pattern into the sheet.

It is another object of the present invention to increase the air permeability of the fabric and thus a more efficient operation.

It is a further object of the present invention to improve sheet drying rate and therefore reduce energy consumption.

It is yet another object of the present invention to improve the cleanability of the fabric.

The present invention will now be described in more complete detail with frequent reference being made to the drawing figures, which are identified below.

BRIEF DESCRIPTION OF THE DRAWING

For a more complete understanding of the invention, reference is made to the following description and accompanying drawings, in which.

DETAILED DESCRIPTION OF THE PREFERRED EMBODIMENTS

The present invention is preferably a TAD fabric having improved pocket depth and pocket volume on the paper side surface of the fabric. The pocket sizes are a function of the weave pattern, mesh count, and yarns used in the pattern. Pocket sizes can be characterized by an MD/CD dimension and/or by a pocket depth. The pockets are formed/bounded by weft yarns and warp yarns which are raised from the base plane of the fabric surface, produced by the weave pattern utilized. Pocket size and depth affect resultant sheet properties such as absorbency amongst others.

Figure 1A:
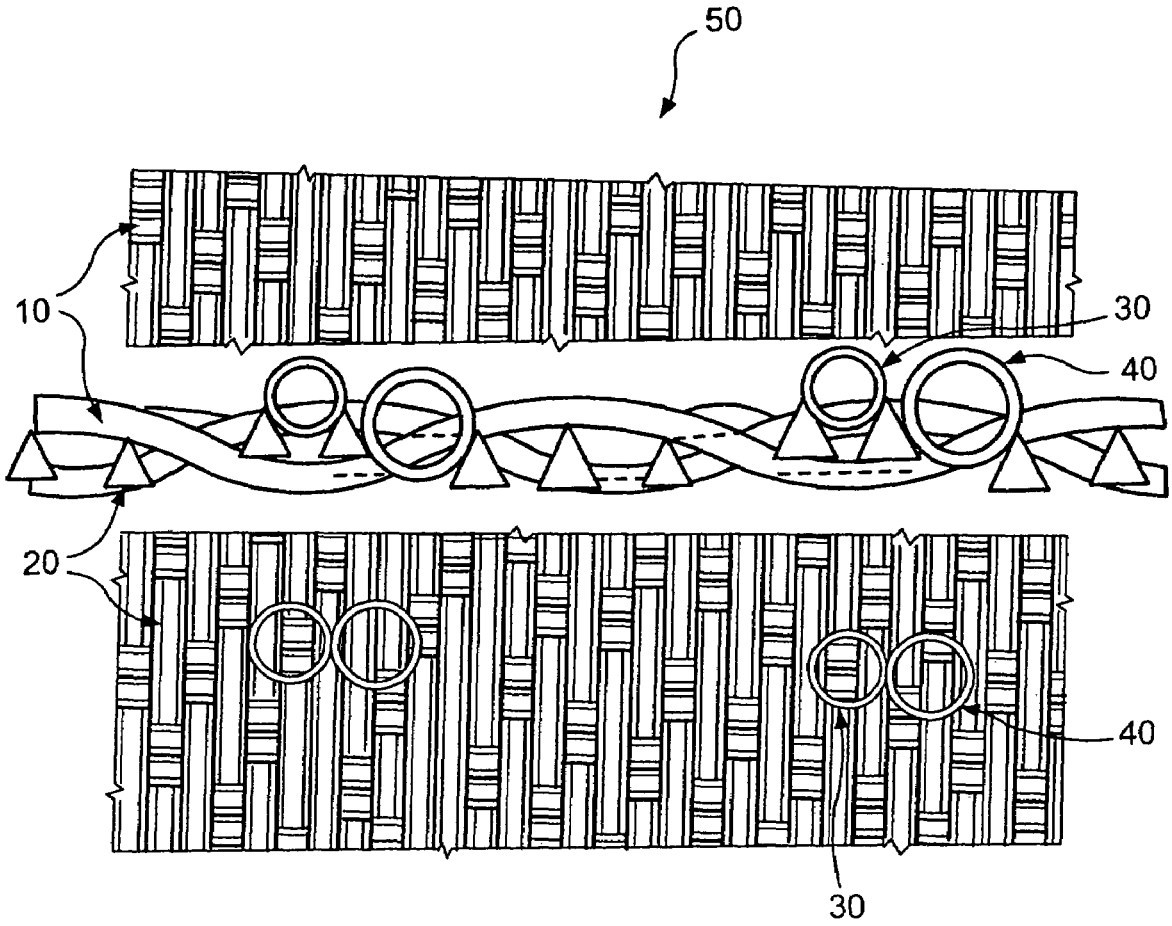
FIG. 1A shows a paper side view and a surface depth view highlighting the relative pocket sizes on the paper side surface of a preferred embodiment of the present invention.

FIG. 1A shows a paper side view and a surface depth view highlighting the relative pocket sizes on the paper side surface of a preferred embodiment of the present invention. As shown in FIG. 1A a fabric 50 according to this embodiment may be formed using weft yarns 20 having a triangular cross-section. While we refer to weft yarns as having a triangular cross-section in reality the cross-section would be that shown in FIG. 1B. As can be seen therein the weft yarns 20 have a somewhat or substantially triangular cross-section with slightly rounded edges 22. While an equilateral triangular shape is shown having sides 24, other triangular shapes suitable for the purpose may also provide the desired results. In FIG. 1A the triangular weft yarns 20 are shown to run horizontally and the warp yarns 10 run vertically. Weft yarns 20 may be oriented within fabric 50 in a manner such that a flat surface or side 24 of the triangle is facing the machine side of fabric 50 and a pointed side of the triangle is facing the paper or surface side of fabric 50, with the points interlacing with the warp yarns 10 as they pass over and under the triangular weft yarns 20 producing increased pocket depth. FIG. 1C also shows the warp yarn 10 contour for the fabric pattern according to this embodiment. Note as to warp yarns 10 they are shown having a circular cross-section. Other shaped cross-sections suitable for the purpose are possible. As seen in this contour, the fabric 50 has deeper pockets 30, 40, which are correspondingly highlighted on the paper side surface of fabric 50. It can be observed that the raised weft yarns 20 and raised warp yarns 10 indicated in the paper side surface of the fabric 50 form the pockets 30, 40 at points where they interweave with each other or points interlacing with the warp as they pass over and under the triangular weft yarns 20, producing increased pocket depths.

Orientation of the triangular weft yarns in this manner (flat surface facing the machine side) will also greatly change the bottleneck profile for both the 5-shed weave designs discussed in the background of the invention. This means, for a given mesh and count, the air permeability of the fabric will also increase. Therefore, by keeping the same mesh and count, the fabric according to the present invention will maintain its robustness in the hot, humid TAD environment, as well as result in increased sheet caliper and absorbency or softness, overcoming the drawbacks of the prior art.

Figure 1B:
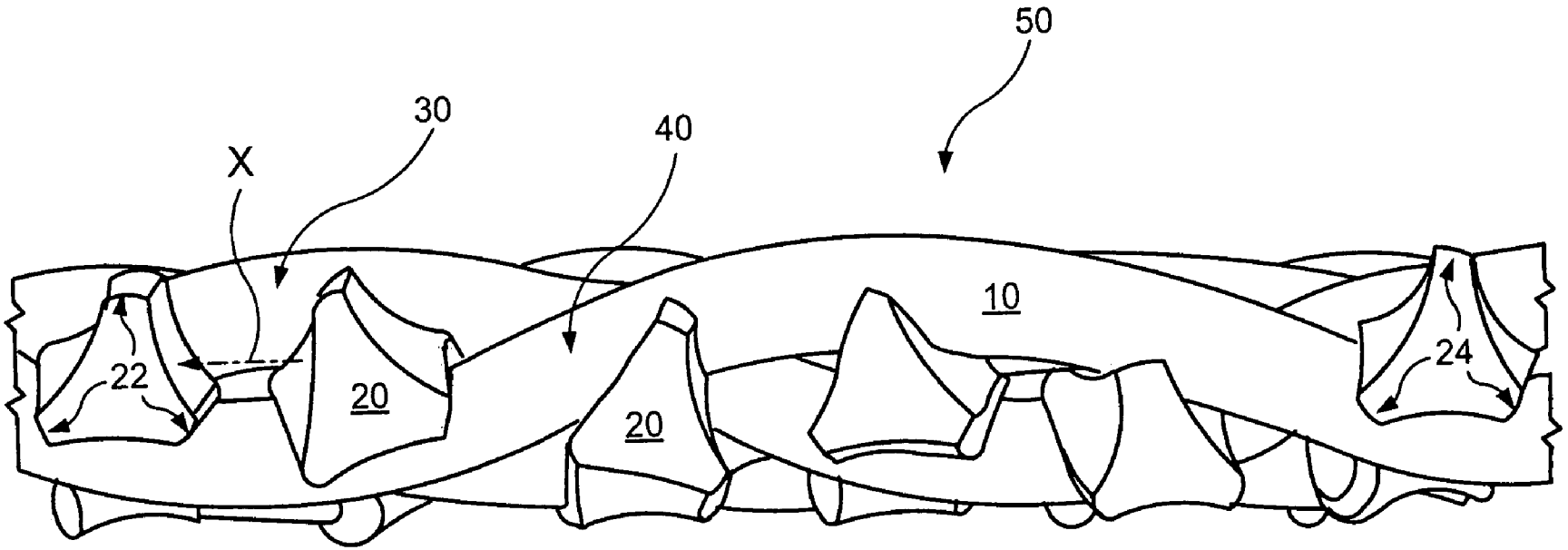
FIGS. 1B and 1C show cross-sectional views of a fabric incorporating the teachings of the present invention.
Figure 1C:
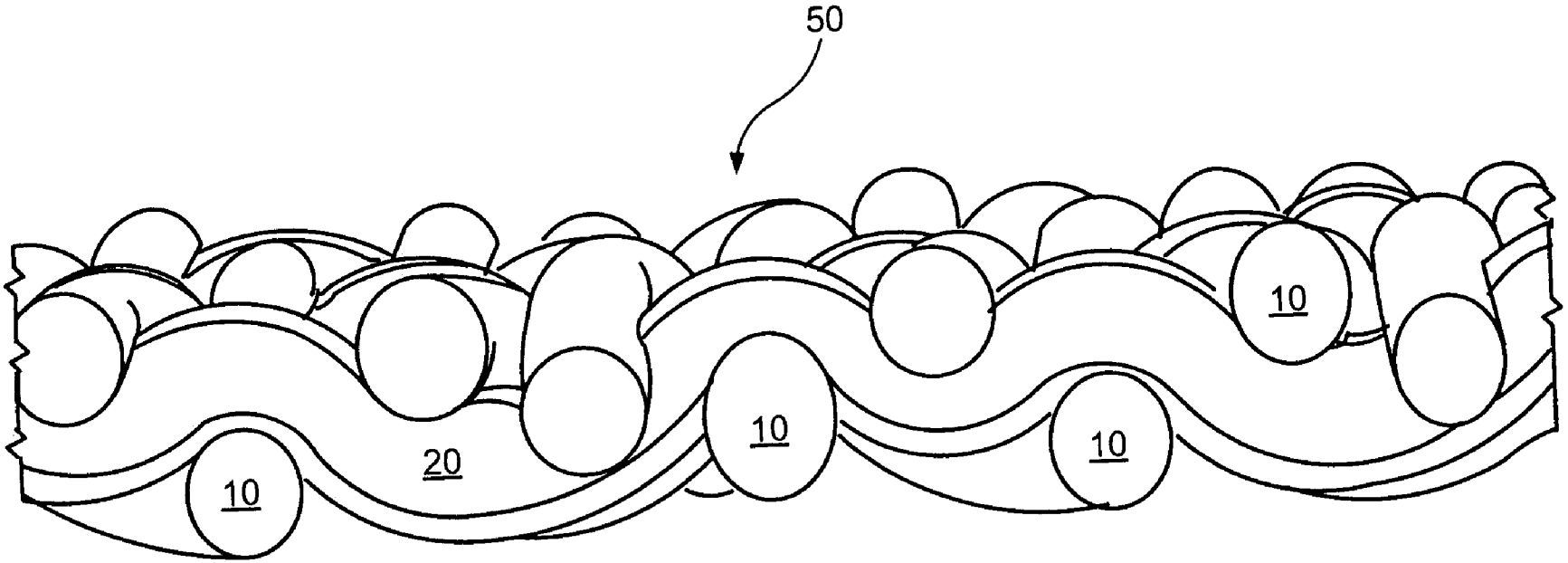
Figure 1D:
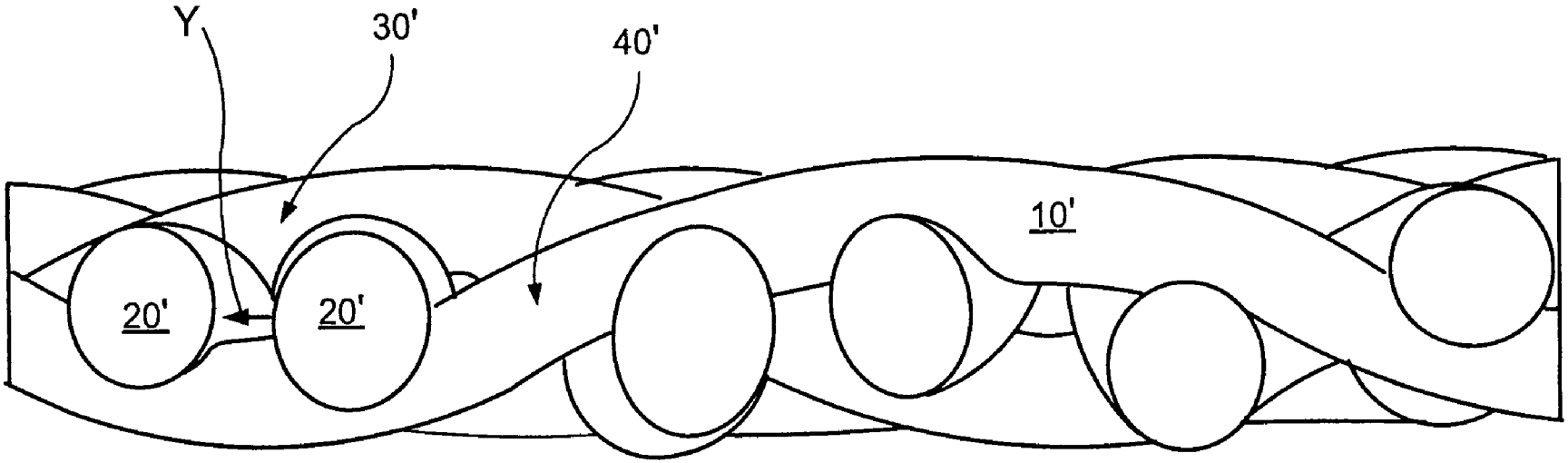
FIG. 1D shows a cross-sectional view of a standard TAD fabric.

In this regard for point of comparison, there is shown in FIG. 1D a cross-sectional view of a standard TAD fabric woven in the same weave pattern as that shown in FIG. 1B with, however, using yarns having circular cross-section yarns. The weft yarns have been designated 20' and the warp yarns designated 10'. If one compares the pocket areas formed on FIG. 1D at 30' and 40' to the pockets 30 and 40 in FIG. 1B one can see that the pockets created are larger in the latter due to the substantially triangular shaped cross-section yarns. This can be seen, for example, in the open area between adjacent yarns which has been designated "X" in FIG. 1B and "Y" in FIG. 1D. Accordingly for the same linear density of yarns, larger pockets are formed in the fabric shown in FIG. 1B with the attendant advantages.

Note the fabric according to the present invention may be formed using any weave pattern, such as for example, plain, twill, sheet surface having floats weft or warp dominant or combinations thereof. The present invention is intended to cover other fabric patterns having different sizes and shapes of pockets, different pocket depths, and different yarn contours. Accordingly, the present invention should not be construed as being limited to the preferred embodiment disclosed above.

Figure 2:
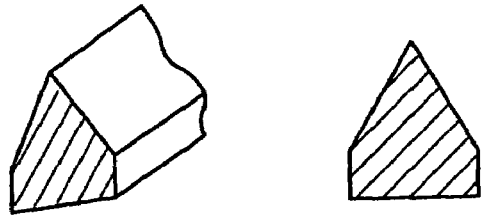
FIG. 2 shows a "house" shaped cross-section of a yarn.

The fabric according to the present invention preferably comprises only monofilament yarns, preferably of polyester, nylon, polyamide, or other polymers. Any combination of polymers for any of the yarns can be used as will be appreciated by one of ordinary skill in the art. The CD yarns of the fabric may have a triangular cross-sectional yarns of different sizes and may alternate with yarns having different non-triangular cross-sections such as circular or other shapes. Such alternation can be single or in pairs or other combinations of yarns in even or odd numbers in a manner suitable for the purpose Similarly, the MD yarns may have a circular cross-section with one or more different diameters. Further, in addition to triangular and circular cross-sectional shapes, other shapes are envisioned such as the "house" shaped yarn 60 shown in FIG. 2. Moreover some of the yarns, including the MD yarns may have other cross-sectional shapes such as a rectangular cross-sectional shape or a non-round cross-sectional shape such as triangular or substantially triangular.

Modifications to the above would be obvious to those of ordinary skill in the art, but would not bring the invention so modified beyond the scope of the present invention. The claims to follow should be construed to cover such situations.

What is claimed is:

1. A fabric for use on a papermaking machine, comprising:

a plurality of warp yarns interwoven with a plurality of substantially triangular shaped weft yarns to produce pockets on a paper-side surface of the fabric;

wherein the triangular weft yarns are oriented with a flat surface facing a machine side surface of the fabric; and wherein points where the warp yarns interlace with the triangular weft yarns produce deeper pockets when compared to a standard fabric woven in the same weave pattern using circular cross-section yarns, and larger open pocket areas between adjacent triangular weft yarns when compared to a standard fabric woven with the same linear density using circular cross-section yarns.

2. The fabric according to claim 1, having a 5-shed weave pattern comprising a plurality of warp and weft yarn contours.

3. The fabric according to claim 1, wherein at least some of the plurality of warp yarns and the plurality of triangular weft yarns are one of polyamide yarns or polyester yarns.

4. The fabric according to claim 1, wherein the fabric is a single layer through-air-drying (TAD) fabric.

5. The fabric according to claim 1, wherein at least some of the plurality of warp yarns have one of a circular cross-sectional shape, a rectangular cross-sectional shape, a non-round cross-sectional shape or a triangular or substantially triangular shape.

6. The fabric according to claim 1, wherein said fabric further comprises a plurality of weft yarns have a non-triangular cross-section.

7. The fabric according to claim 6 wherein said triangular weft yarns and non-triangular weft yarns alternate, alternate in pairs or otherwise alternate in a desired manner.

8. A method of forming a fabric for use on a papermaking machine, the method comprising the steps of:

interweaving a plurality of warp yams with a plurality of substantially triangular shaped weft yarns to produce pockets on a paper-side surface of the fabric;

wherein the triangular weft yams are oriented with a flat surface facing a machine side surface of the fabric; and wherein points where the warp yarns interlace with the weft yarns produce deeper pockets when compared to a standard fabric woven in the same weave pattern using circular cross-section yams, and larger open pocket areas between adjacent triangular weft yarns when compared to a standard fabric woven with the same linear density using circular cross-section yarns.

9. The method according to claim 8, wherein the fabric is a 5-shed weave pattern comprising a plurality of warp and weft yarn contours.

10. The method according to claim 8, wherein at least some of the plurality of warp yams and the plurality of triangular weft yams are one of polyamide yarns or polyester yarns.

11. The method according to claim 8, wherein the fabric is a single layer through-air-drying (TAD) fabric.

12. The method according to claim 8, wherein at least some of the plurality of warp yarns have one of a circular cross-sectional shape, a rectangular cross-sectional shape, a non-round cross-sectional shape, or triangular or substantially triangular shape.

13. The method according to claim 8, further comprising the step of providing a plurality of weft yams have a non-triangular cross-section.

14. The method according to claim 13 wherein said triangular weft yarns and non-triangular weft yarns alternate, alternate in pairs or otherwise alternate in a desired manner.

* * * * *